US006845744B2

(12) United States Patent
Haman

(10) Patent No.: US 6,845,744 B2
(45) Date of Patent: Jan. 25, 2005

(54) METHOD AND APPARATUS FOR INTER-CYLINDER LUBRICATION TRANSFER IN A MULTI-CYLINDER INTERNAL COMBUSTION ENGINE

(75) Inventor: David F. Haman, Palm City, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/349,616

(22) Filed: Jan. 22, 2003

(65) Prior Publication Data

US 2003/0136369 A1 Jul. 24, 2003

Related U.S. Application Data

(60) Provisional application No. 60/319,093, filed on Jan. 22, 2002.

(51) Int. Cl.[7] ..... F01M 1/00

(52) U.S. Cl. ..... 123/196 R; 123/196 CP

(58) Field of Search ..... 123/196 R, 196 CP, 123/196 W

(56) References Cited

U.S. PATENT DOCUMENTS

| | | | | |
|---|---|---|---|---|
| 3,911,870 A | | 10/1975 | Hackbarth | |
| 4,121,551 A | | 10/1978 | Turner | |
| 4,599,979 A | | 7/1986 | Breckenfeld et al. | |
| 4,831,979 A | | 5/1989 | DuBois et al. | |
| 5,513,608 A | | 5/1996 | Takashima et al. | |
| 5,537,959 A | * | 7/1996 | Ito | 123/73 AD |
| 5,950,588 A | | 9/1999 | Kusche et al. | |
| 6,058,900 A | * | 5/2000 | Kusche et al. | 123/196 CP |
| 6,067,952 A | | 5/2000 | Andrasko et al. | |
| 6,286,476 B1 | * | 9/2001 | Hiraoka et al. | 123/196 W |
| 6,318,331 B1 | * | 11/2001 | Hiraoka et al. | 123/196 R |
| 6,484,681 B2 | * | 11/2002 | Kuroda | 123/90.33 |
| 6,652,338 B2 | * | 11/2003 | Takahashi | 440/88 R |

* cited by examiner

*Primary Examiner*—Henry C. Yuen
*Assistant Examiner*—Jason Benton
(74) *Attorney, Agent, or Firm*—BRP Legal Services

(57) ABSTRACT

The present invention is directed to a lubrication system for a multi-cylinder internal combustion engine. An inter-cylinder lubricant communications system is provided to circulate lubricant from an upper-most cylinder to each successive cylinder downstream. This system includes an inlet that extends through an opening in the wall of a downstream cylinder. An outlet situated upstream relative to the inlet is also provided and includes an accumulation region to collect lubricant as it flows with the charging air from the crankcase chamber to the combustion chamber of an engine cylinder. A fluid passage is configured to fluidly interconnect the inlet to the outlet to pass lubricant from the upstream cylinder to the downstream cylinder. A passage is provided from the most downstream cylinder to the most upstream cylinder thereby allowing for re-circulation of the lubricant. The system takes advantage of a pressure differential between any two successive cylinders to draw the excess oil from one cylinder to the next.

21 Claims, 3 Drawing Sheets

METHOD AND APPARATUS FOR INTER-CYLINDER LUBRICATION TRANSFER IN A MULTI-CYLINDER INTERNAL COMBUSTION ENGINE

CROSS REFERENCE TO RELATED APPLICATION

The present application claims the benefit of U.S. Ser. No. 60/319,093 filed Jan. 22, 2002.

BACKGROUND OF THE INVENTION

The present invention is related generally to internal combustion engines, and, more particularly, to an inter-cylinder lubrication system for a two-cycle internal combustion engine.

In certain known internal combustion engines, a cylinder block can be arranged with two banks of vertically-stacked cylinders. In a six-cylinder engine, for example, each cylinder bank has three cylinders. Each cylinder includes a sleeve and a piston which moves relative to the sleeve between top dead center and bottom dead center positions. It will be appreciated that the foregoing terminology of top dead center and bottom dead center is used for the sake of traditional usage and is not meant to describe the piston/cylinder geometry in engines having vertically-stacked cylinders since the reciprocating motion of the piston occurs along a generally horizontal axis as opposed to the more traditionally oriented vertical axis. As indicated from the traditional "top dead center" and "bottom dead center" terminology, more often than not, internal combustion engines are orientated horizontally with respect to the crankshaft such that the pistons and cylinders are arranged generally in the vertical. Granted, in "V" engines, each piston and cylinder assembly is not perfectly vertical, but it is well known that the center of the "V" is generally arranged in the vertical. However, there are many applications that require the engine to be mounted in the vertical. That is, the crankshaft orientation is in the vertical, and the piston-cylinder arrangements assemblies are orientated generally in the horizontal. Such applications can include outboard motors, personal watercraft, lawn and garden equipment, snowmobiles, etc.

In a typical two-stroke engine, there is no oil sump to lubricate the internal components of the engine. Therefore, oil is either mixed with the fuel prior to being drawn into the engine, or is injected directly into the crankcase area to provide the necessary lubrication. In a typical crankcase-scavenged two-stroke engine, whether it be carbureted or fuel injected, crankcase fluid is moved from the crankcase to the combustion chamber through at least one transfer passage which connects the crankcase to the combustion chamber and wherein the piston acts as a valve opening and closing the ports to and from the transfer passage. The crankcase fluid consists of gasoline, air, and oil for typical carbureted and port fuel injected engines, and air and oil in typical direct fuel injected (DFI) engines. During engine operation of a vertically oriented two-stroke crankcase-scavenged engine, oil from the crankcase fluid tends to separate from the other constituents and gather in the lower portions of the crankcase and transfer passage, as influenced by gravity. This separated oil is then directionally influenced to move from the crankcase to the combustion chamber by the motion of the crankcase fluid as it moves from the crankcase to the combustion chamber through the transfer passage. Once the oil reaches the transfer passage, its duty as a lubricant is mostly complete. In such prior art engines, this excess lubricant is drawn into the combustion chamber with the crankcase fluid and is consumed in the combustion process. This leads to increased pollutants exhausted from the engine and inefficient use of oil.

Therefore, it would be desirable to design a lubrication system that prevents entry of excess oil into the combustion chamber thereby limiting the output pollutants of the engine and makes more efficient use of lubricating oil within the engine. In this regard, it would be desirable to provide a lubrication system for a non-horizontally arranged engine that re-circulates lubricant downwardly from one crankcase chamber to a next and provide a re-circulation loop to reuse the lubricating oil and not simply burn it in the combustion chamber when its initial function is complete in each cylinder.

BRIEF DESCRIPTION OF THE INVENTION

The present invention is directed to a lubrication system for an internal combustion engine overcoming the aforementioned drawbacks. The invention provides a system which improves lubrication, oil utilization, and reduces output pollutants of a multi-cylinder two-stroke crankcase-scavenged internal combustion engine. The system gathers excess oil that has completed its lubrication task in a given cylinder, and relocates this excess oil in an adjacent cylinder that is downstream of the upstream cylinder. This process in continued from one cylinder to the next until the lowest most cylinder is reached, as which point, oil is returned to the upper-most cylinder. The oil passages are strategically placed so that the excess oil is accumulated at a lowest point in each cylinder before it reaches the combustion chamber, and the inlet passages to each cylinder are strategically placed such that the piston, and more specifically the skirt of the piston, acts as a valve opening and closing this oil inlet port. In this manner, the invention takes advantage of pressure differentials between cylinders to encourage oil movement by opening the port only when the pressure is higher in the supplying crankcase as compared to the pressure in the receiving crankcase. Accordingly, each cylinder of the engine receives improved lubrication and the oil is utilized in a much more efficient manner, and less oil is passed into the combustion chamber and exhausted at pollutants. This results in improved engine durability, lower oil consumption, and lower operating costs, as well in assisting in meeting lower emissions standards.

The engine includes a plurality of cylinders stacked along a generally vertical axis. Each cylinder has a respective piston that reciprocates along a respective cylinder axis generally perpendicular to the vertical axis. An inter-cylinder lubricant communications system is provided and configured to circulate lubricant through each successive cylinder from a top-most cylinder to a bottom-most cylinder in response to a pressure differential between any two successive cylinders. This system includes an inlet that extends through an opening in the wall of a downstream cylinder. An outlet situated upstream relative to the inlet is also provided and includes a notched barrier configured to substantially collect lubricant as it flows from the crankcase chamber to the combustion chamber of the engine cylinder. A connector assembly forming a fluid passage is configured to fluidly interconnect the inlet to the outlet to pass lubricant from the upstream cylinder to the downstream cylinder. A conduit preferably connects the bottom cylinder to the top cylinder thereby allowing for re-circulation of the lubricant.

Therefore, in accordance with one aspect of the present invention, a lubrication system for a multi-cylinder internal combustion engine is provided and includes a lubricant inlet in communication with a second piston-cylinder assembly and configured to receive lubricant from a first piston-cylinder assembly. The lubrication system further includes a lubricant outlet having a barrier region configured to collect lubricant from a first piston-cylinder assembly wherein the lubricant outlet is situated upstream relative to the lubricant inlet. An inter-cylinder lubricant path is also provided and connected to the lubricant inlet at one end and connected to the lubricant outlet at an opposite end.

In another aspect of the present invention, an internal combustion engine includes an engine block having a crankcase chamber for each of a plurality of cylinders wherein each of the cylinders has a respective combustion chamber. The engine also includes a piston, with a depending skirt, disposed in each cylinder and configured to reciprocate along a respective cylinder axis. A transfer passage is located adjacent each cylinder and is provided and configured to pass charging air from a respective crankcase chamber to a respective combustion chamber. The transfer passage is defined by a plurality of passage walls wherein one of the passage walls includes a lubricant accumulation region. An inter-cylinder lubricant system is also provided within the engine and configured to pass lubricant from the lubricant accumulation region of one cylinder to another cylinder. The engine also includes a lubricant re-circulation system configured to re-circulate lubricant from the lubricant accumulation region of a most-downstream cylinder to a most-upstream cylinder.

In accordance with yet another aspect of the present invention, a method of lubricating an internal combustion engine having a plurality of piston-cylinder assemblies includes the steps of drawing a mixture of lubricant and combustion supporting fluid into a crankcase chamber of a piston-cylinder assembly and circulating the mixture from a crankcase chamber through a transfer passage of the piston-cylinder assembly toward a combustion chamber of the piston-cylinder assembly. The method further includes accumulating a lubricant portion of the mixture in an accumulation region of the transfer passage wherein the accumulation region is defined by a protrusion extending from an interior surface of the transfer passage. The accumulated portion of the lubricant mixture is then discharged through an opening in the transfer passage wherein the opening is situated generally adjacent to the protrusion.

In accordance with a further aspect of the present invention, a method of manufacturing an internal combustion engine for a marine propulsion device is provided and includes constructing an engine block and defining an engine cylinder in the engine block. The method further includes the steps of positioning a piston to be reciprocally moveable in the engine cylinder and defining a combustion chamber by mounting a cylinder head to the engine block. A sealed crankcase chamber is then defined wherein the crankcase chamber is disposed opposite the combustion chamber and has the piston positioned therebetween. The method further includes the steps of providing a crankshaft in the crankcase chamber and attaching the crankshaft to be rotatably connected to the piston. A transfer passage is then defined for passing a mixture of lubricant and a combustion supporting fluid from the crankcase chamber to the combustion chamber. The method also includes the step of providing an opening and an angular protrusion adjacent the opening in a wall of the transfer passage to separate excess oil from the mixture.

Another aspect of the present invention includes an internal combustion engine having means for inputting a mixture of lubricant and combustion supporting fluid into crankcase chamber of a piston-cylinder assembly. The engine further includes means for passing the mixture from the crankcase chamber to a combustion chamber of the piston-cylinder assembly as well as means for accumulating a portion of the mixture while passing the mixture. The engine further includes means for discharging the portion of the mixture directly into another crankcase.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
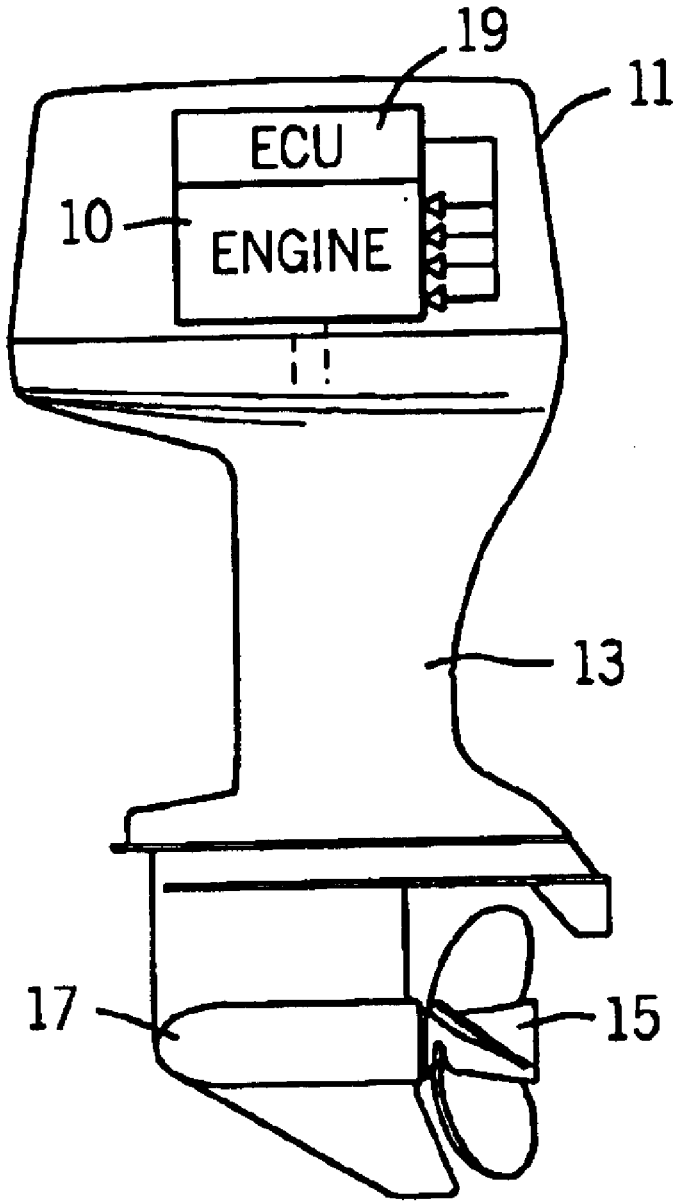
FIG. 1 is a side elevational view of an outboard motor having an engine constructed in accordance with a preferred embodiment of the present invention.

The present invention is applicable to two-stroke engines that can be arranged in which gravitational forces can have detrimental effects on emission levels and lubrication. Applications for such engines can include outboard marine engines, personal watercraft engines, snowmobiles, lawn and garden equipment, etc. One such engine 10, illustrated in FIG. 1, comprises an outboard two-stroke internal combustion engine. The engine is housed in a powerhead 11 and supported on a mid-section 13 configured for mounting on the transom of a boat (not shown) in a known conventional manner. An output shaft (not shown) of the engine 10 is coupled to drive a propeller 15 extending rearwardly of a lower gearcase 17 via the mid-section 13. The engine 10 is controlled by an electronic control unit (ECU) 19. While the present invention is shown in FIG. 1 as being incorporated into an outboard motor, the present invention is also applicable with many other applications, including inboard or stern drive systems. The invention is particularly useful where the crankshaft is arranged in a non-horizontal application.

Although an exemplary embodiment of the present invention is described herein in connection with a direct fuel injected (DFI) system such as a single fluid, pressure surge direct in-cylinder fuel injection system, the invention can be used in connection with many other fuel systems including, for example, dual fluid, air-assisted direct in-cylinder fuel injection, throttle body fuel injection, port or multi-port fuel injection, and carbureted fuel systems.

Figure 2:
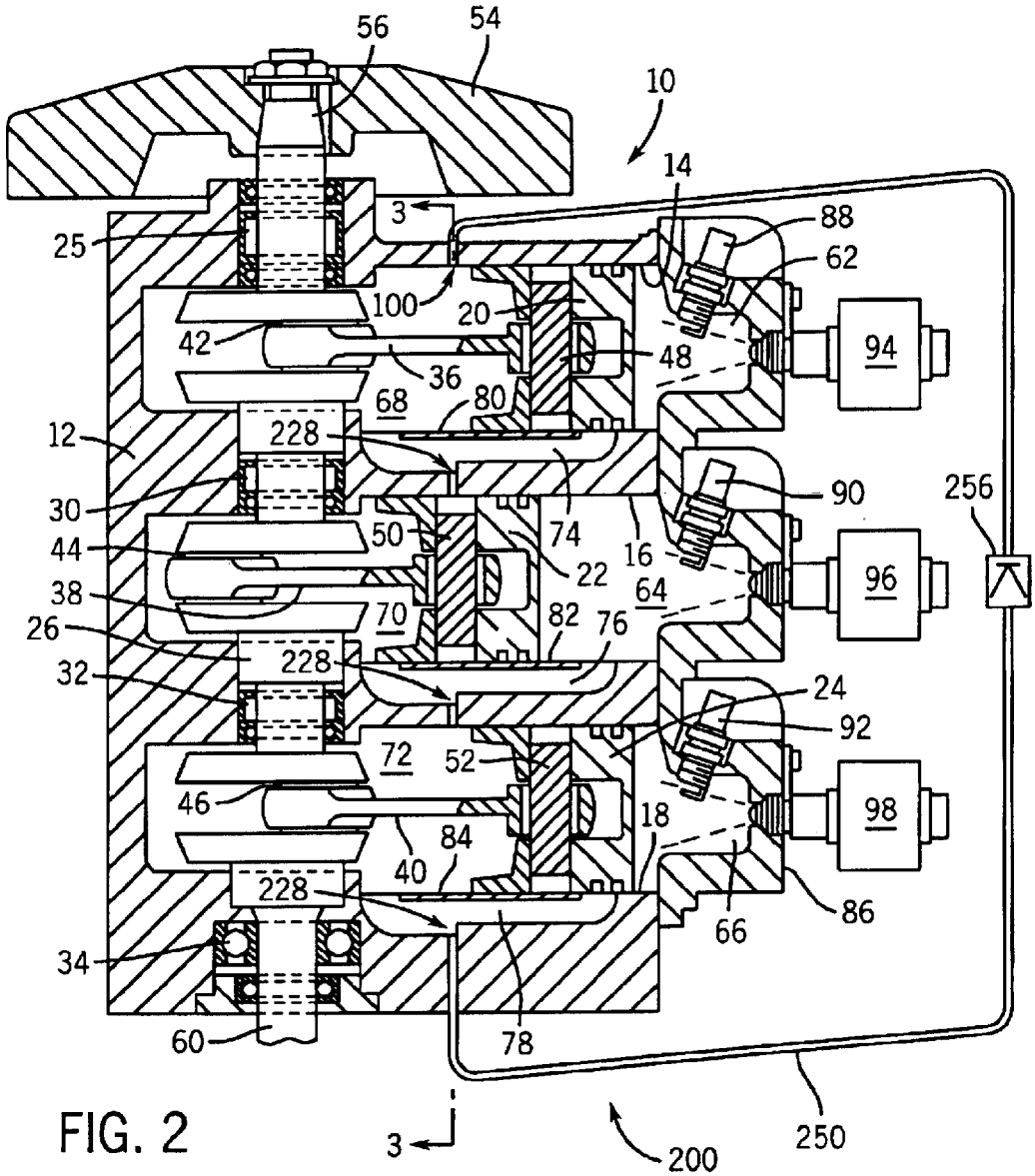
FIG. 2 is a cross-sectional view of an exemplary two-cycle internal combustion engine having a lubrication system in accordance with one aspect of the present invention.

Referring to FIG. 2, engine 10 includes an engine block 12 of a loop-scavenge-type two-cycle engine incorporating the present invention. For exemplary reasons, the engine is depicted with three cylinders. However, engines with differing number of cylinders can take advantage of the present invention as will become evident. Engine 10 has an uppermost horizontally positioned cylinder 14, a centrally disposed horizontal cylinder 16, and a lowermost horizontally positioned cylinder 18. Each cylinder has therein a reciprocating piston 20, 22, 24, respectively, driven by a crankshaft 26. The crankshaft 26 extends vertically through the engine block 12 and is rotatably supported within bearing assemblies 28, 30, 32, 34. Each piston 20, 22, 24 is connected to the crankshaft 26 with a respective connecting rod 36, 38, 40 coupled to the crankshaft 26 through a crankshaft journal 42, 44, 46. The connecting rods 36, 38, 40 are connected to each piston 20, 22, 24 with a wristpin 48, 50, 52. A flywheel 54 is secured to an upper threaded end 56 of the crankshaft 26 by a locking nut 58. A lower end 60 of the crankshaft 26 extends from the engine 10 to provide power, for example, to the propeller 15 of the outboard motor shown in FIG. 1.

Each cylinder of engine 10 includes a combustion chamber above the piston and a crankcase below the piston. As is well known, each of the combustion chambers 62, 64, 66 is isolated and sealed from one another. Each of the crankcase chambers 68, 70, 72 is also isolated and sealed from one another and therefore, a pressure differential is created between cylinders, which will be discussed in further detail hereinafter. Each cylinder has at least one transfer passage 74, 76, 78 that connects the crankcase 68, 70, 72 to a respective combustion chamber 62, 64, 66. In the embodiment shown in FIG. 2, the transfer passages 74, 76, 78 are located in a lower region 80, 82, 84 of each cylinder. The transfer passages 74, 76, 78 are used to transfer pressurized combustion supporting fluids from the crankcase 68, 70, 72 to the combustion chamber 62, 64, 66 with the piston 20, 22, 24 acting as a valve opening and closing the transfer passages 74, 76, 78.

An upper end of the combustion chamber 62, 64, 66 is formed by sealingly fastening a cylinder head 86 to an upper surface of the engine block 12. The cylinder head 86 may be a single cylinder head covering each of the cylinders 14, 16, 18, or can include separate cylinder heads attached to each cylinder. In either case, the cylinder head(s) 86 includes a spark plug 88, 90, 92 for each cylinder, and in a preferred embodiment, includes a fuel injector 94, 96, 98 to directly inject fuel into each combustion chamber. The fuel injectors and spark plugs are controlled by a controller which is preferably formed integrally with the ECU 19 of FIG. 1 to control the operation of the fuel injectors and spark plugs to periodically ignite fuel charges in the combustion chambers.

Engine 10 includes a lubrication re-circulation system 200 that connects and transfers oil from an upper-most cylinder 14 to a central cylinder 16 via an inter-cylinder lubricant communication arrangement 228. Similarly, a second inter-cylinder lubricant communication arrangement 228 connects the central cylinder 16 to transfer excess oil to the lowermost cylinder 18. The inter-cylinder lubricant communication arrangement 228 is preferably formed at the lowest gravitational point of each cylinder so that excess lubricant can be transferred and re-circulated from one cylinder to another. This arrangement provides recycling of lubricant rather than allowing the lubricant to be consumed in the combustion process in the combustion chambers 62, 64, 66. Once the oil reaches the lowest point in the lowermost cylinder 18, another inter-cylinder lubricant communication arrangement 228 is connected to a re-circulation passage 250 to return the oil back up to the upper-most cylinder 14 at entrance 100. While the flow of oil is primarily governed by the position of the piston and the pressure differential in the crankcases, the re-circulation passage 250 is preferably equipped with a check valve 256 in applications where the conduit forming the re-circulation passage 250 is of extended length. That is, in some applications, it is believed that such a one-way check valve positioned in the re-circulation passage 250 would be beneficial in certain applications where the transfer conduit is excessively long. The one-way check valve 256 is installed to permit flow to the downstream receiving cylinder and restrict backflow, however, it is understood that such a check valve is not required and only functions to enhance the main mechanism for oil transfer, which is the pressure differential between crankcases and control of these pressure differentials by piston position. The lubrication system 200 will be described in further detail with reference to FIGS. 3 and 4.

The present invention provides a system to improve lubrication flow, oil utilization, and emissions in a multi-cylinder two-stroke internal combustion engine, and in particular, a crankcase scavenge two-stroke engine employing various scavenging processes, including but not limited to, Schneurle Loop Scavenging, Cross Scavenging, and Uniflow Scavenging. The invention is directed toward removing excess oil within a cylinder before it enters the combustion chamber. That is, excess oil that has completed its lubrication task is removed, and relocated to another cylinder of the engine so that this excess oil can be utilized for lubrication purposes and not consumed in the combustion process. This process is repeated from one cylinder to the next such that each cylinder receives adequate lubrication and less oil is consumed in the combustion process and emitted as pollutants.

In a typical crankcase scavenge-type two-stroke engine, whether fuel injected or carbureted, the crankcase fluid that is moved from the crankcase to the combustion chamber via the transfer passage(s) consists of at least combustion air and lubrication oil. In carbureted and port fuel injected engines, the crankcase fluid also includes gasoline. In a direct fuel injected engine, the crankcase fluid includes combustion air and oil only. Oil is provided for the necessary lubrication of the internal moving parts that include the piston against the cylinder walls, the wristpin between the connecting rod and the piston, bearing lubrication between the crankshaft and the connecting rod, and the crankshaft support bearings. Ensuring that there is always an adequate supply of oil present for lubrication can result in the presence of excess oil. If this excess oil is not removed, it will be consumed in the combustion process and emitted as pollutants. The present invention provides a solution to this problem by gathering this excess oil in the lowermost point of the cylinder, and in particular, in the transfer passage, and relocates the excess oil to an area of need in an another cylinder. This is accomplished by providing a passage route between cylinders, a re-circulation loop, and a pressure differential to encourage the movement of the excess oil along a preferred path. The passage is constructed to provide a conduit from the bottom surface of each cylinder's lowest transfer passage, through the cylinder and engine block and into a next, lower, cylinder that is positioned directly below the source cylinder taking advantage of natural gravitational forces. The excess oil from the previous cylinder is then used in the next cylinder for lubrication. Then, after a period of engine operation, the oil is then collected in the lowest transfer passage in the receiving cylinder and is then relocated to the next adjacent cylinder in the same manner as previously described. This technique of relocating or displacing oil from one cylinder to the next continues until the lowest cylinder is reached, and at that point, the oil is transferred to the upper-most cylinder via a conduit which provides a passageway to carry the oil from the transfer passage of the lowest cylinder back up to the upper-most cylinder.

In order to properly transfer the excess oil from one cylinder to the next, and from the lowest cylinder to the upper-most cylinder, it is desirable to take advantage of pressure differentials that are naturally inherent in each of the crankcase chambers. By utilizing these pressure differentials, the oil can be moved by not only gravitational forces, but assisted by the difference in pressure between each of the crankcase chambers. That is, to encourage oil flow from one cylinder to the next, it is desirable to time the transfer such that the pressure in the providing crankcase is higher than the pressure in the receiving crankcase. The present invention accomplishes the transfer of excess oil by using the piston as a valve and carefully selecting the location of the oil passage between cylinders, making it possible to take advantage of the pressure differentials between the cylinders. The excess oil path is open during the period when the providing crankcase has a higher pressure to allow oil to move from the providing crankcase to the receiving crankcase. However, when the pressure increases in the receiving crankcase, above that in the providing crankcase, the piston skirt closes off the excess oil path. Details of this system will now be described with reference to FIGS. 3–4.

Figure 3:
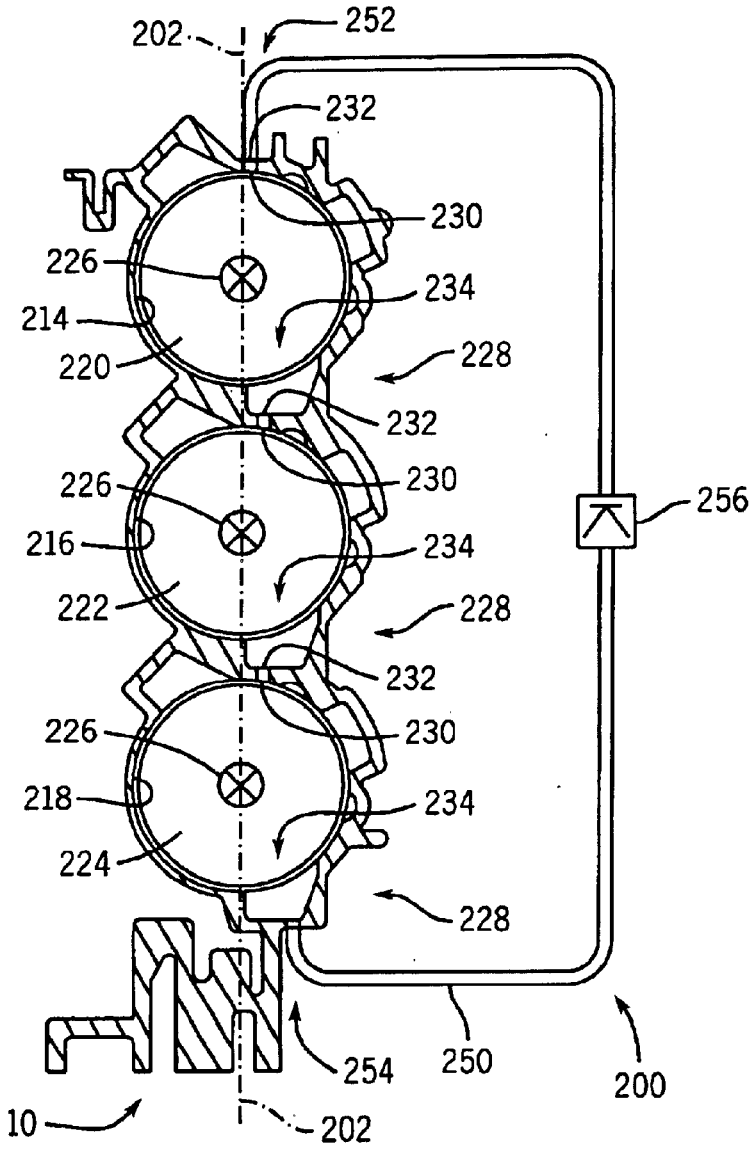
FIG. 3 is a side cross-sectional view in partial schematic of the lubrication system as used with the internal combustion engine shown in FIG. 2 generally about line 3—3.

Referring to FIG. 3, one exemplary embodiment of the present invention is shown in a side cross-sectional view taken along line 3—3 of FIG. 2. A lubrication system 200 is shown for the internal combustion engine 10. As mentioned above, engine 10 includes a plurality of cylinders, e.g., 214, 216, 218 stacked along a generally vertical axis 202. Each cylinder has a respective piston 220, 222, 224 therein that reciprocates along a respective cylinder axis 226 that is generally perpendicular relative to vertical axis 202. System 200 includes an inter-cylinder lubrication communication arrangement 228 configured to allow lubricant, e.g., oil, to pass from an upper-most or upstream cylinder 214 to a downstream cylinder 216, and then to a bottom-most downstream cylinder 218 in response to a pressure differential between adjacent cylinders, as described in greater detail below. It will be appreciated that the inter-cylinder lubricant communication arrangement is not limited to three cylinder engines since one skilled in the art will readily recognize that the present invention can be adapted to engines including more than three cylinders.

Figure 4:
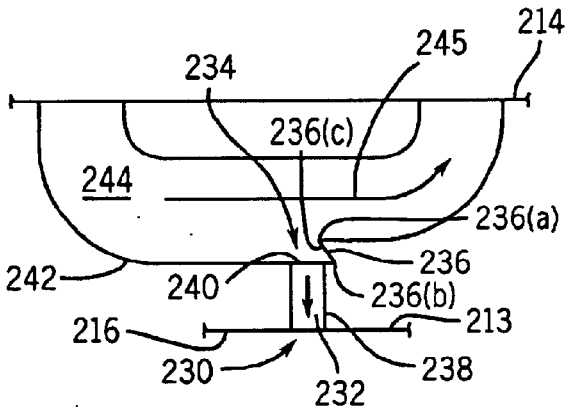
FIG. 4 is a schematic illustration of an inter-cylinder communication system in accordance with the present invention as used with the internal combustion engine shown in FIGS. 1–3.

The inter-cylinder lubricant communication arrangement 228 is disposed between each upstream cylinder and each downstream cylinder. The arrangement 228 includes a respective lubricant inlet port 230 for each cylinder 214, 216, 218 configured to extend through a respective opening 232. A lubricant outlet port 234 is situated upstream relative to inlet port 230 and includes an oil retaining ledge or notched barrier region 236, as best shown in FIG. 4, configured to collect excess lubricant that flows within the cylinder 214, for example. A connector 238 may be used to connect inlet port 230 and outlet port 234 to form a fluid passage to pass lubricant from cylinder 214 to cylinder 216. Outlet port 234 includes a respective opening 240 through a wall 242 of a transfer passage 244 of each cylinder. Passage 244 allows for passing combustion-supporting fluid 245, e.g., at least fresh charging air and oil, and in some embodiments air, oil, and fuel, from the crankcase to the combustion chamber as the piston reciprocates. The notched barrier region 236 is situated in close proximity to opening 240. To improve oil collection efficiency, the notch 236 and opening 240 are preferably disposed in the lowest point within the cylinder. The notch 236 includes a leading edge 236(*a*), a trailing edge 236(*b*), and a face 236(*c*) extending diagonally from the trailing edge 236(*b*) to the leading edge 236(*a*). Notch 236 is situated such that the face is oriented in a direction opposite to a flow direction 245 of the charging fluid. It will be appreciated that the geometrical configuration of notch barrier 236 is not limited to the angular protrusion shown in FIG. 4 since other configurations may be chosen provided any chosen configuration provides for directing excess oil into opening 240 without inducing substantial disturbance to the charging fluid flow 245 passing through transfer passage 244.

The oil retaining ledge, or notched barrier region 236, is preferably located on a lower surface of the transfer passage to provide a barrier to the oil that is moving along the lower surface of the transfer passage from the crankcase to the combustion chamber as motivated by the moving crankcase fluid as depicted by arrow 245 in FIG. 4. Preferably, the barrier region is positioned just downstream of the conduit entrance 240 and acts as a dam to provide a reservoir of oil at the entrance of the conduit. In one configuration, the oil barrier region extends the full width of the transfer passage and is positioned substantially perpendicular to the direction of flow of the crankcase fluid as it flows through the transfer passage. Alternately, the oil barrier region could be angled relative to the direction of flow of the crankcase fluid. In such a configuration, the conduit entrance 240 would be positioned near the downstream portion of the angled ledge 236. The motion of the crankcase fluid would then act upon the retained oil and move the retained oil to a more focused location near the conduit entrance to provide improved oil utilization and improved oil flow efficiency. In yet another embodiment, the barrier region could be "V" shaped relative to the direction of crankcase fluid flow as it flows through the transfer passage as indicated by arrow 245. In this configuration, the point of the "V" is located in the downstream position and the conduit entrance would be located just upstream of the "V". This arrangement would also encourage the flow of retained oil toward the conduit entrance.

The lubricant re-circulation assembly 200 is configured to fluidly interconnect a most-downstream cylinder to a most-upstream cylinder and includes a re-circulation passage 250 connected to cylinder 214 at one end 252 and to cylinder 218 at another end 254. The re-circulation passage 250 may include a check valve 256 biased to prevent backflow of lubricant. The re-circulation passage 250 may include lubricant flow passages that are internal to the engine within the crankcase walls using well-known engine construction techniques. These passages may be formed by machining of the engine block 12 or may be formed when the engine block is fabricated, e.g., during casting operations. These connecting passages could also be defined in whole or in part by other means, such as hoses or conduits.

In operation, the present invention improves lubrication flow in engines having vertically-stacked cylinders such as in outboard engines. In one aspect thereof, the present invention provides an inter-cylinder communications arrangement between a top-most cylinder through to the bottom-most cylinder so that oil that otherwise may be consumed and lost is passed to areas where it may be reused. The lubrication communications arrangement is aided by pressure differentials between successive cylinders as a function of respective piston position. Once oil has reached the bottom-most cylinder, a passage or connector is provided for recycling oil back from the bottom-most cylinder to the top-most cylinder so that the lubrication action is repeated.

Therefore, in accordance with one embodiment of the present invention, a lubrication system for a multi-cylinder internal combustion engine is provided and includes a lubricant inlet in communication with a second piston-cylinder assembly and configured to receive lubricant from a first piston-cylinder assembly. The lubrication system further includes a lubricant outlet having a barrier region configured to collect lubricant from a first piston-cylinder assembly wherein the outlet is situated upstream relative to the lubricant inlet. An inter-cylinder lubricant path is also provided and connected to the lubricant inlet at one end and connected to the lubricant outlet at an opposite end.

In another embodiment of the present invention, an internal combustion engine includes an engine block having a crankcase chamber for each of a plurality of cylinders wherein each of the cylinders includes a respective combustion chamber. The engine also includes a piston, each piston including a skirt and disposed in each cylinder and configured to reciprocate along a respective cylinder access. A transfer passage located adjacent each cylinder is provided and configured to pass charging air from respective crankcase chamber to the combustion chamber. The transfer passage is defined by a plurality of passage walls wherein one of the passage walls includes a lubricant accumulation region. An inter-cylinder lubricant system is also provided within the engine and configured to pass lubricant from the lubricant accumulation region of one cylinder to another cylinder. The engine also includes a lubricant re-circulation system configured to re-circulate lubricant from the lubricant accumulation region of a most-downstream cylinder to a most-upstream cylinder.

In accordance with yet another embodiment of the present invention, a method of lubricating an internal combustion engine having a plurality of piston-cylinder assemblies includes the steps of drawing a mixture of lubricant and combustion-supporting fluid into a crankcase chamber of a piston-cylinder assembly and circulating the mixture from a crankcase chamber through a transfer passage of the piston-cylinder assembly toward a combustion chamber of the piston-cylinder assembly. The method further includes accumulating a lubricant portion of the mixture in an accumulation region of the transfer passage wherein the accumulation region is defined by a protrusion extending from an interior surface of the transfer passage. The accumulated portion of the lubricant mixture is then discharged through an opening in the transfer passage wherein the opening is situated generally adjacent to the protrusion.

In accordance with a further embodiment of the present invention, a method of manufacturing an internal combustion engine for a marine propulsion device includes the steps of constructing an engine block and defining an engine cylinder in the engine block. The method further includes the steps of positioning a piston to be reciprocally moveable in the engine cylinder and defining a combustion chamber by mounting a cylinder head to the engine block. A sealed crankcase chamber is then defined wherein the crankcase chamber is disposed opposite the combustion chamber and has the piston positioned therebetween. The method also includes providing a crankshaft in the crankcase chamber and attaching the crankshaft to be rotatably connected to the piston. A transfer passage is then defined for passing a mixture of lubricant and a combustion-supporting fluid from the crankcase chamber to the combustion chamber. The method also includes the step of providing an opening and an angular protrusion adjacent the opening in a wall of the transfer passage to separate excess oil from the mixture.

Another embodiment of the present invention includes an internal combustion engine having means for inputting a mixture of lubricant and combustion-supporting fluid into a crankcase chamber of a piston-cylinder assembly. The engine further includes means for passing the mixture from the crankcase chamber to a combustion chamber of the piston-cylinder assembly as well as means for accumulating a portion of the mixture while passing the mixture. The engine further includes means for discharging the portion of the mixture directly into another crankcase.

The present invention has been described in terms of the preferred embodiment, and it is recognized that equivalents, alternatives, and modifications, aside from those expressly stated, are possible and within the scope of the appending claims.

What is claimed is:

1. A lubrication system for a multi-cylinder internal combustion engine, the lubrication system comprising:

a lubricant outlet having a barrier region configured to collect lubricant from a first piston-cylinder assembly, the lubricant outlet being situated upstream relative to the lubricant inlet;

a lubricant inlet in communication with a second piston-cylinder assembly configured to receive lubricant from a first piston-cylinder assembly;

an inter-cylinder lubricant path connected to the lubricant inlet at one end and connected to the lubricant outlet at an opposite end;

a lubricant re-circulation system to re-circulate lubricant from a bottom-most piston-cylinder assembly to an upper-most piston-cylinder assembly, the lubricant re-circulation system comprising:

an inlet at one end in fluid communication with the bottom-most piston-cylinder assembly;

an outlet at another end in fluid communication with the upper-most piston-cylinder assembly; and a check valve disposed between the inlet and the outlet of the lubricant re-circulation system wherein the check valve is biased to prevent lubricant flow from the upper-most piston-cylinder assembly to the bottom-most piston-cylinder assembly through the lubricant re-circulation system.

2. The lubrication system of claim 1 wherein the barrier region includes a notch to direct excess oil toward the lubricant outlet.

3. The lubrication system of claim 2 wherein the notch includes a leading edge, a trailing edge, and a face extending diagonally from the trailing edge to the leading edge.

4. The lubrication system of claim 3 wherein the barrier region is located in a charging air transfer passage and the face is oriented in a direction opposite to charging air flow.

5. The lubrication system of claim 1 wherein the barrier region is further configured to collect lubricant from the first piston cylinder assembly without inducing a substantial disturbance to charging airflow in the first piston-cylinder assembly.

6. The lubrication system of claim 1 wherein the lubricant outlet is configured to discharge lubricant to the lubricant inlet through the inter-cylinder lubricant path in response to a pressure differential between the first and second piston-cylinder assemblies.

7. The lubrication system of claim 1 wherein each piston-cylinder assembly includes a piston reciprocally movable in a cylinder and wherein each piston has a skirt and each cylinder has a transfer passage, and wherein a respective piston skirt periodically opens and closes passage to the lubricant inlet and the piston periodically opens and closes passage of the transfer passage.

8. The lubricant system of claim 1 wherein the inlet is in an open position when a pressure in the first piston-cylinder assembly is higher than a pressure in the second piston-cylinder assembly.

9. An internal combustion engine comprising:

an engine block having a crankcase chamber for each of a plurality of cylinders, each of the cylinders including a respective combustion chamber;

a piston disposed in each cylinder, each piston configured to reciprocate along a respective cylinder axis and having a skirt depending therefrom;

a transfer passage located adjacent each cylinder, the transfer passage configured to pass charging air from a respective crankcase chamber to a respective combustion chamber, the transfer passage defined by a plurality of passage walls, wherein one of the passage walls includes a lubricant accumulation region;

an inter-cylinder lubricant system configured to pass lubricant from the lubricant accumulation region of one cylinder to another cylinder; and a lubricant re-circulation system configured to re-circulate lubricant from the lubricant accumulation region of a most-downstream cylinder to a most-upstream cylinder, the lubricant re-circulation system having a check valve therein biased to prevent lubricant return.

10. The internal combustion engine of claim 9 wherein excess lubricant is drawn into a downstream cylinder by a pressure differential between the crankcase of the downstream cylinder and the crankcase of an upstream cylinder.

11. The internal combustion engine of claim 9 wherein the inter-cylinder lubricant system includes:

a discharge port configured to extend through an opening in a wall of each respective cylinder;

an intake port situated upstream relative to the discharge port, the intake port configured to extend through an opening in the transfer passage and further configured to fluidly communicate with the lubricant accumulation region; and a connector configured to fluidly interconnect the discharge port to the intake port.

12. The internal combustion engine of claim 11 wherein the connector includes at least one passage routed within the engine block.

13. The internal combustion engine of claim 11 wherein the connector includes at least one passage externally routed relative to the engine block.

14. The internal combustion engine of claim 9 positioned such that the plurality of cylinders is in a vertically-stacked arrangement and wherein each lubricant accumulation region is at a lowest-most point of the respective cylinder.

15. The internal combustion engine of claim 9 wherein the lubricant accumulation region includes at least one notched protrusion in the transfer passage, the at least one notched protrusion configured to collect lubricant flowing within the transfer passage.

16. The internal combustion engine of claim 15 wherein the at least one notched protrusion extends angularly from one of the passage walls.

17. The internal combustion engine of claim 9 wherein the inter-cylinder lubricant system includes an opening formed in a respective cylinder such that the opening is periodically closed off of lubricant flow by a pistol reciprocal therein.

18. A method of manufacturing an internal combustion engine for a marine propulsion device, the method comprising the steps of:

constructing an engine block;

defining an engine cylinder in the engine block;

positioning a piston to be reciprocally movable in the engine cylinder;

defining a combustion chamber by mounting a cylinder head to the engine block;

defining a sealed crankcase chamber, the crankcase chamber disposed opposite the combustion chamber and having the piston positioned therebetween;

providing a crankshaft in the crankcase chamber; attaching the crankshaft to be rotatably connected to the piston;

defining a transfer passage for passing a mixture of lubricant and combustion-supporting fluid from the crankcase chamber to the combustion chamber;

providing an opening and an angular protrusion adjacent the opening in a wall o transfer passage to separate excess oil from the mixture;

providing a re-circulation path from the opening in the transfer passage to the crankcase chamber of a second cylinder to pass the separated excess oil discharged through the opening to the crankcase chamber of the second cylinder; and providing a check valve in the re-circulation path.

19. The method of claim 18 further comprising the steps of providing an inlet in the crankcase chamber of each engine cylinder in a position such that it is periodically obstructed by a piston skirt as the piston reciprocates therein.

20. The method of claim 19 further comprising the step of utilizing a pressure differential between adjacent cylinders to draw excess oil from one cylinder into a next cylinder.

21. An internal combustion engine comprising:

an engine block having a crankcase chamber for each of a plurality of cylinders, each of the cylinders including a respective combustion chamber;

a piston disposed in each cylinder, each piston configured to reciprocate along a respective cylinder axis and having a skirt depending therefrom;

a transfer passage located adjacent each cylinder, the transfer passage configured to pass charging air from a respective crankcase chamber to a respective combustion chamber, the transfer passage defined by a plurality of passage walls, wherein one of the passage walls includes a lubricant accumulation region;

an inter-cylinder lubricant system configured to pass lubricant from the lubricant accumulation region of one cylinder to another cylinder; and a lubricant re-circulation system configured to re-circulate lubricant from the lubricant accumulation region of a most-downstream cylinder to a most-upstream cylinder, the inter-cylinder lubricant system comprising:

a discharge port configured to extend through an opening in a wall of each respective cylinder;

an intake port situated upstream relative to the discharge port, the intake port configured to extend through an opening in the transfer passage and further configured to fluidly communicate with the lubricant accumulation region; and a connector configured to fluidly interconnect the discharge port to the intake port, wherein the connector includes at least one passage externally routed relative to the engine block.

* * * * *